United States Patent [19]

Nakanishi et al.

[11] Patent Number: 4,805,589

[45] Date of Patent: Feb. 21, 1989

[54] FIRE-EXTINGUISHING DEVICE FOR OIL BURNER

[75] Inventors: Yutaka Nakanishi; Toshihiko Yamada; Shigeo Gamou, all of Aichi, Japan

[73] Assignee: Toyotomi Kogyo Co., Inc., Japan

[21] Appl. No.: 186,985

[22] Filed: Apr. 27, 1988

[51] Int. Cl.[4] ..... F24C 5/04

[52] U.S. Cl. ..... 126/96; 431/307; 251/248

[58] Field of Search ..... 126/96; 431/304, 307, 431/315; 251/248, 180

[56] References Cited

U.S. PATENT DOCUMENTS

| | | | |
|---|---|---|---|
| 4,363,620 | 12/1982 | Nakamura et al. | 431/33 |
| 4,550,709 | 11/1985 | Nakamura et al. | 126/96 |
| 4,610,239 | 9/1986 | Nakamura et al. | 126/96 |
| 4,613,298 | 9/1986 | Harada et al. | 431/307 |
| 4,688,546 | 8/1987 | Akita et al. | 126/96 |

FOREIGN PATENT DOCUMENTS 61-25962 6/1986 Japan .

*Primary Examiner*—Randall L. Green
*Assistant Examiner*—Denise L. Ferensic
*Attorney, Agent, or Firm*—Pollock, Vande Sande & Priddy

[57] ABSTRACT

A fire-extinguishing device for an oil burner capable of preventing a wind blowing against the oil burner from adversely affecting combustion operation of the oil burner through the fire-extinguishing device to ensure safe combustion operation. The device includes a valve for operating an aperture through which an air chamber communicated through a wick receiving chamber to a combustion cylinder construction is communicated to an oil reservoir communicated to an ambient atmosphere. The valve is actuated to open and close the aperture when a wick is at a wick raised position and a wick lowered position, so that air may be supplied from the ambient atmosphere through the space of the oil reservoir, air chamber and wick receiving chamber to the combustion cylinder construction for combustion during combustion operation.

10 Claims, 3 Drawing Sheets

FIRE-EXTINGUISHING DEVICE FOR OIL BURNER

BACKGROUND OF THE INVENTION

1. Field of the Invention

This invention relates to a fire-extinguishing device for an oil burner, and more particularly to a fire-extinguishing device of the type that an air chamber is arranged outside a wick receiving chamber through which the wick receiving chamber is selectively communicated with an ambient atmosphere.

2. Description of the Prior Art

A fire-extinguishing device of such a type as described above is classified into two types. One type is that air is introduced from an air chamber to a wick receiving chamber at the time of fire-extinguishing. The device tends to discharge bad odor to a room during fire-extinguishing, accordingly, it is constructed to open, only in an emergency such as earthquake, a through-hole via which the air chamber is communicated with an ambient atmosphere. The other type is that introduction of air from an ambient atmosphere through an air chamber and a wick receiving chamber to a combustion section is stopped by closing a through-hole of an air chamber for communicating the air chamber to an ambient with a valve at the time of fire-extinguishing.

The assignee proposed a fire-extinguishing device for an oil burner which accomplishes rapid fire-extinguishing by only operation of lowering a wick through a wick operating shaft and put it into practice. The device is typically disclosed in U.S. Pat. No. 4,363,620 issued on Dec. 14, 1982 and Japanese patent publication No. 25962/1986 corresponding thereto, the disclosure of which is incorporated by reference. In the fire-extinguishing device disclosed, a wick receiving chamber is formed into a width larger than a thickness of a wick received therein so as to allow air to pass through the wick receiving chamber. Also, an air chamber is so arranged that it may be communicated to the wick receiving chamber through an opening defined between both chambers. The air chamber is provided with a through-hole via which it is communicated directly to an ambient atmosphere and which is opened or closed by a valve, so that air may be fed from an ambient atmosphere through the air chamber and wick receiving chamber to a combustion section of an oil burner during combustion operation of the oil burner. Such construction permits the air chamber to be filled with fresh air during combustion operation. In fire-extinguishing operation, the through-hole of the air chamber is closed with the valve and the wick is lowered to a level below the opening between the wick receiving chamber and the air chamber, resulting in a flame being drawn into the wick receiving chamber. The flame then consumes air in the closed air chamber to reduce pressure of the air chamber and fuel oil gas vaporized from the lowered wick is then diffused into the air chamber of reduced pressure, to thereby lead to fire-extinguishing. Thus, it will be noted that the fire-extinguishing device proposed significantly prevents discharge of bad odor to a room because of preventing fuel oil gas generated during fire-extinguishing operation from being diffused to the room.

In the conventional fire-extinguishing device described above, the valve is adapted to keep the through-hole of the air chamber open during combustion operation of the oil burner and the opened through-hole is exposed directly to an ambient atmosphere. Accordingly, the fire-extinguishing device often causes an excessive amount of air to be introduced via the through-hole into the combustion section to deteriorate combustion characteristics of the oil burner, particularly when wind blows against the oil burner.

Also, misuse of gasoline of high volatility as compared with kerosene has much possibility of causing vapor of gasoline to leak from an oil reservoir of an oil burner through an opening or through-hole of the oil reservoir to a room to lead to a fire. Unfortunately, the conventional fire-extinguishing device fails to take any step to avoid such a danger.

Also, in the conventional fire-extinguishing device described above, a valve actuating mechanism for actuating the valve for operating the through-hole of the air chamber is complicated in its structure and troublesome in assembling. Also, the prior art fails to provide a valve structure which is successfully applied to the fire-extinguishing devices of both types described above.

SUMMARY OF THE INVENTION

The present invention has been made in view of the foregoing disadvantages of the prior art.

Accordingly, it is an object of the present invention to provide a fire-extinguishing device for an oil burner which is capable of effectively preventing wind blowing against the oil burner from adversely affecting combustion operation of the oil burner through the fire-extinguishing device.

It is another object of the present invention to provide a fire-extinguishing device for an oil burner which is capable of permitting the oil burner to exhibit satisfactory combustion characteristics irrespective of a wind blowing against the oil burner.

It is a further object of the present invention to provide a fire-extinguishing device for an oil burner which is capable of ensuring safe combustion operation of the oil burner irrespective of fuel oil.

It is still another object of the present invention to provide a fire-extinguishing device for an oil burner which is capable of eliminating a danger due to misuse of fuel oil.

It is yet another object of the present invention to provide a fire-extinguishing device which is capable of effectively eliminating a danger of a fire due to use of gasoline by mistake.

It is even another object of the present invention to provide a fire-extinguishing device for an oil burner which is capable of significantly simplified in its structure.

It is still a further object of the present invention to provide a valve structure for a fire-extinguishing device for an oil burner which is highly simplified in its structure.

It is yet a further object of the present invention to provide a valve structure for a fire-extinguishing device for an oil burner which is capable of being satisfactorily applied to any kind of a fire-extinguishing device.

In accordance with one aspect of the present invention, a fire-extinguishing device for an oil burner including an oil reservoir for storing fuel oil therein which is communicated to an ambient atmosphere is provided. The fire-extinguishing device includes a wick receiving chamber for movably receiving a wick therein which is formed into a width larger than a thickness of the wick so as to be communicated to a combustion cylinder construction of the oil burner. Adjacent to the wick receiving chamber is arranged an air chamber which is provided with an opening for communicating the air chamber therethrough to the wick receiving chamber. The opening of the air chamber is arranged at a position above an upper end of the wick when the wick is at a wick lowered position. The device also includes a valve provided at the air chamber and actuated in association with movement of the wick so as to be opened and closed when the wick is at a wick raised position and a wick lowered position, respectively. The valve is arranged at a portion of the air chamber positioned in a space of the oil reservoir to cause the air chamber to be communicated therethrough to the oil reservoir and then an ambient atmosphere when the valve is opened.

In accordance with another aspect of the present invention, there is also provided a valve structure for a fire-extinguishing device for an oil burner. The valve structure is adapted to operate an aperture or through-hole provided at an outer wall of an air chamber of the fire-extinguishing device to selectively communicate the air chamber to an ambient atmosphere as desired. The valve structure includes a valve body arranged in the air chamber in a manner to be interposed between an outer wall of the air chamber and power transmitting means of the fire-extinguishing device. The power transmitting means is operatively connected between power generating means of the fire-extinguishing device and its wick moving means and moved by the power generating means to vertically move a wick through the wick moving means. The valve body is fixedly connected to the force transmitting means so as to be moved with the force transmitting means. The valve structure further includes a spring for constantly forcing the valve body against the outer wall of the air chamber to cause the valve body to selectively close depending on its movement with the power transmitting means.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a fire-extinguishing device for an oil burner will be described hereinafter with reference to the accompanying drawings.

Figure 1:
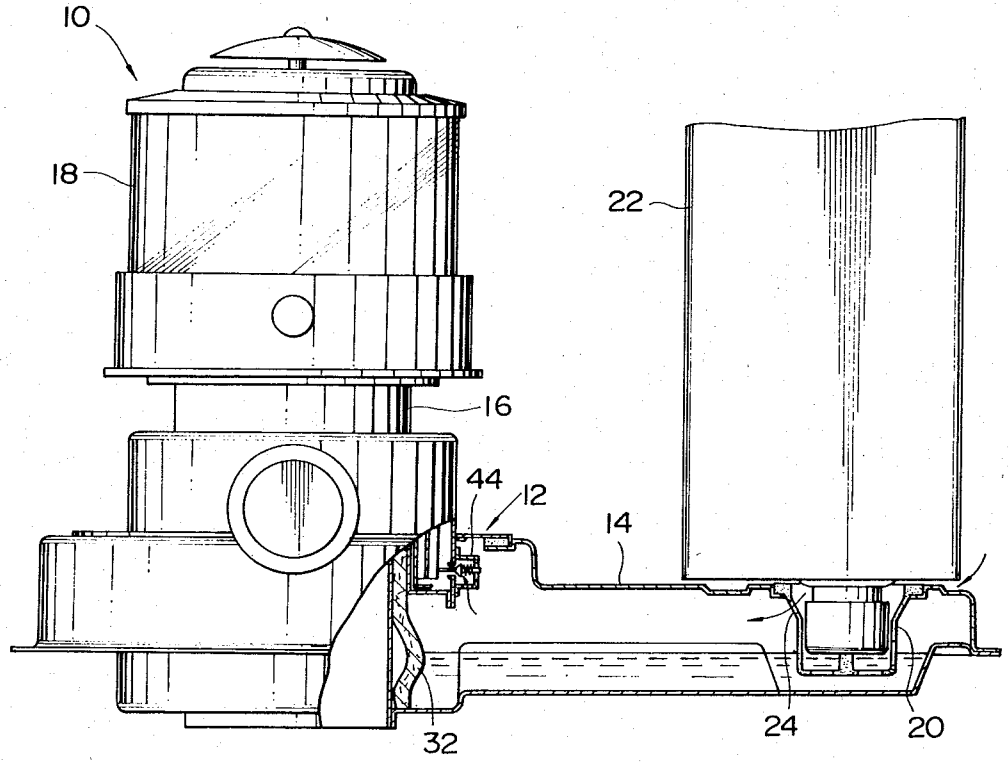
FIG. 1 is a front elevation view partly in section showing an example of an oil burner in which a fire-extinguishing device of the present invention is adapted to be incorporated.

FIG. 1 exemplifies an oil burner in which an embodiment of a fire-extinguishing device according to the present invention is adapted to be incorporated, wherein an oil burner and a fire-extinguishing device are generally designated by reference numerals 10 and 12, respectively. The oil burner 10 illustrated in FIG. 1 is of the oil fired space heater type, however, the present invention is not limited to an oil fired space heater.

First, the oil burner 10 will be briefly described with reference to FIG. 1.

The oil burner 10 per se is constructed in such a manner as widely known in the art. It includes an oil reservoir 14 for receiving therein fuel oil such as kerosene, a wick receiving cylinder construction 16 arranged on the oil receiver 14, and a combustion cylinder construction 18 supported on the wick receiving cylinder construction 16. The oil reservoir 14 is provided on a top wall thereof with a recess 20 for invertedly supporting thereon an oil tank 22 in which fuel oil is stored. The recess 20 is formed with small through-holes 24 via which the oil reservoir 14 is communicated with an ambient atmosphere. Fuel oil stored in the oil tank 22 is supplied from the tank to the oil reservoir 14 as fuel oil in the oil reservoir 14 is consumed in combustion operation. The wick receiving cylinder construction 16 is communicated with the oil reservoir 14 and combustion cylinder construction 18. The combustion cylinder construction 18 is adapted to carry out combustion of fuel oil vaporized from a wick received in the wick receiving cylinder construction 16 in combustion operation, as described below. For this purpose, the combustion cylinder construction 18 may be constructed in a manner similar to that disclosed in U.S. Pat. No. 4,363,620.

Figure 2:
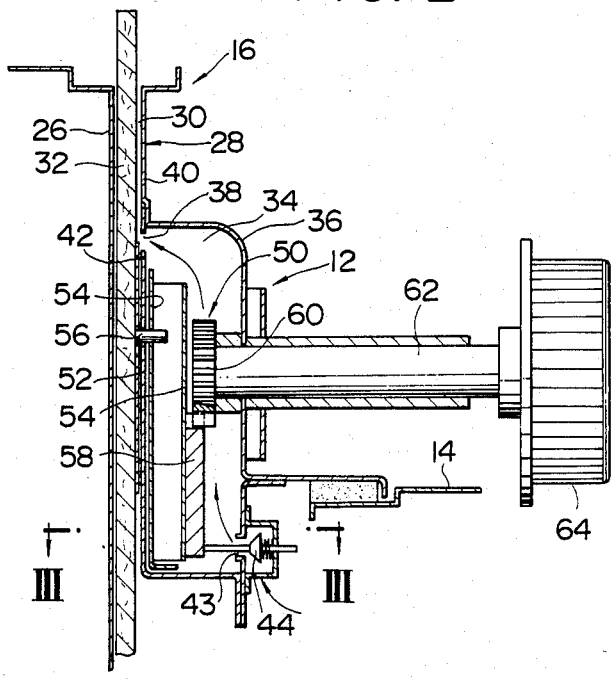
FIG. 2 is a fragmentary sectional view showing an essential part of an embodiment of a fire-extinguishing device according to the present invention.

The fire-extinguishing device of the illustrated embodiment includes a portion of the wick receiving cylinder construction 16 and is arranged adjacent to the wick receiving cylinder construction 16 and oil reservoir 14, as shown in FIGS. 1 and 2. The wick receiving cylinder construction 16 includes an inner cylinder 26 and an outer cylinder 28 between which an annular chamber 30 communicated to the combustion cylinder construction 18 and oil reservoir 14 is defined for receiving a wick 32 therein. The annular chamber 30 is formed into a width larger than a thickness of the wick 32. The wick 32 is received in the annular chamber or wick receiving chamber 30 so as to be vertically movable. The wick 32, when the oil burner is to be ignited, is raised to a lower portion of the combustion cylinder construction 18 (wick raised position) as shown in FIG. 2.

Around the wick receiving cylinder construction 16 is arranged an annular air chamber 34 which, in the illustrated embodiment, is formed by the outer cylinder 28 of the wick receiving cylinder construction 16 which constitutes an inner wall of the chamber 34 and an annular cover plate 36 of a substantially top-open bell-like shape arranged around the outer cylinder 28 to constitute an outer wall of the chamber 34. The annular air chamber 34 is formed with an annular opening or slit 38 for communicating the air chamber 34 therethrough to the wick receiving chamber 30. For this purpose, in the illustrated embodiment, the outer cylinder 28 of the wick receiving cylinder construction 16 comprises two sections or an upper cylindrical member 40 and a lower cylindrical member 42 between which the annular slit 38 is defined. The annular opening 38 is formed at a position above an upper end of the wick 32 which is lowered to a wick lowered position or into the wick receiving chamber for fire-extinguishing. In the illustrated embodiment, the annular opening 38 is arranged at an upper portion of the air chamber 34.

Also, in the fire-extinguishing device of the illustrated embodiment, the air chamber 34 is provided on an outside thereof with an aperture or through-hole 43, which is operated or opened and closed by a valve 44. The valve 44 is positioned in an inner space of the oil reservoir 14 or arranged at a position constantly above a level of fuel oil in the reservoir 14 so as to communicate the air chamber 34 through the valve 44 to the inner space of the oil reservoir 14 which is communicated via the through-holes 24 of the recess 20 to an ambient atmosphere.

Reference numeral 50 designates a wick actuating mechanism. The wick actuating mechanism 50 includes an annular wick retaining plate 52 which is arranged between the wick 32 and the lower cylindrical member 42 of the outer cylinder 28 of the wick receiving cylinder construction 16 to press the wick 32 against the inner cylinder 26 of the wick receiving cylinder construction 16 and define a gap between the wick retaining plate 52 and the lower cylindrical member 42 of the outer cylinder 28, to thereby rotatably hold the wick 32 thereon and ensure communication between the air chamber 34 through the annular chamber 30 of the wick receiving cylinder construction 16 to the combustion cylinder construction 18. Thus, it will be noted that the wick holding plate 52 serves as wick moving means and may be formed into an annular shape. The wick actuating mechanism 50 also includes power transmitting means. More particularly, a plate member 54 is operatively connected to the wick retaining plate 52 for rotating it. The plate member 54 is provided outside of the lower cylindrical member 42 of the outer cylinder 28 or arranged in the air chamber and is adapted to be circumferentially moved. The plate member 54 may be connected to the wick retaining plate 52 by means of pin means 56 in such a manner as known in the art. The power transmitting means of the wick actuating mechanism 50 further includes a rack 58 fixedly mounted on the plate member 54 and a pinion 60 engaged with the rack 58. The pinion 60 is provided at one end of a wick operating shaft 62 which is rotatably mounted on a burner body of the oil burner 10 and acts as power generating means of the wick actuating mechanism 50. The wick operating shaft 62 is provided at the other end thereof with a knob 64.

Figure 3:
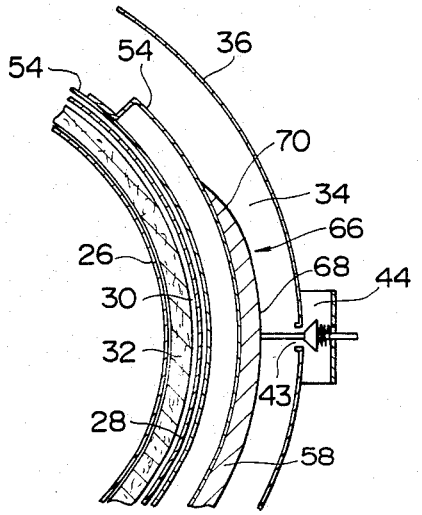
FIG. 3 is a sectional view taken along substantially line III—III of FIG. 2.

The valve 44 for selectively communicating the air chamber 34 through the aperture or through-hole 43 to the oil reservoir 14 is adapted to be actuated depending on operation of the oil burner. More particularly, it is adapted to keep the aperture 43 open at the time of ignition and during combustion operation and close it at the time of fire-extinguishing. For this purpose, in the illustrated embodiment, a cam 66 is attached to the power transmitting means of the wick actuating mechanism 50 so as to be operatively connected to the valve 44 to lead to the abovedescribed actuation of the valve 44. In the illustrated embodiment, the cam 66, as shown in FIGS. 2 and 3, is provided on an outer surface of a lower portion of the rack 58. For this purpose, the rack 58, as shown in FIG. 3, is formed into a portion 68 of a uniform thickness and a slanting portion 70 of which a thickness is gradually decreased, so that the uniform-thickness portion 68 of the rack 58 may be engaged with the valve 44 to open the aperture 43 to accomplish communication between the air chamber 34 and the oil reservoir 14 at the wick raised position or at the time of ignition and during combustion operation and the slanting portion 70 may be engaged with it to close the aperture to block the communication at the wick lowered position or at the time of fire-extinguishing.

In the fire-extinguishing device of the illustrated embodiment constructed as described above, the valve 44 causes the air chamber 34 to be selectively communicated through the aperture 43 to the oil reservoir 14 communicated to an ambient atmosphere, so that when it opens the aperture 43 for ignition and combustion, air may be permitted to enter the oil reservoir 14 from an ambient atmosphere via the through-holes 24 of the reservoir 14, flow through the valve to the air chamber 34 and then reach the combustion cylinder construction 18 through the annular opening 38 and wick receiving chamber 30.

Accordingly, the fire-extinguishing device causes the oil reservoir 14 to be kept at a low temperature or the substantially the same temperature as an ambient atmosphere even during combustion operation. Thus, vaporization of fuel oil in the oil reservoir is minimized, resulting in air which is kept at substantially the same temperature as an ambient atmosphere and has substantially the same composition as the ambient atmosphere being supplied from the ambient atmosphere through the oil reservoir 14 and air chamber 34 to the combustion cylinder construction 18 during combustion operation. Accordingly, when the wick 32 is lowered to the fire-extinguishing position and simultaneously the valve closes the aperture 43 for fire-extinguishing, the closed air chamber 34 satisfactorily and rapidly accomplishes fire-extinguishing in cooperation with the annular opening 38. Further, even when a strong wind blows against the oil burner during combustion operation, it does not substantially affect air in the oil reservoir, so that combustion may be effectively continued.

When volatile fuel oil such as gasoline is misused, much vapor continues to be generated therefrom in the oil reservoir 14 during combustion even at a room temperature. The so-produced vapor is guided together with air through the valve 44, air chamber 34 and wick receiving chamber 30 to the combustion cylinder construction 18 due to a draft formed in the combustion cylinder construction 18 during combustion operation and then burned therein, so that it is effectively prevented from escaping from the oil reservoir 14 directly to an ambient atmosphere via the through-holes 24. Thus, it will be noted that the fire-extinguishing device positively eliminates a possibility of a fire and prevents generation of bad odor during combustion operation.

As can be seen from the foregoing, the fire-extinguishing device of the illustrated embodiment is constructed in the manner that the air chamber communicated through the wick receiving chamber to the combustion cylinder construction is communicated through the valve to the oil reservoir, so that air may be supplied from an ambient atmosphere through the space of the oil reservoir to the air chamber. Such construction permits the space of the oil reservoir to serve as a buffer chamber for air to effectively eliminate adverse affection of a wind blowing against the oil burner.

Also, such construction causes vapor of fuel oil in the oil reservoir to be positively guided therefrom through the air chamber to the combustion cylinder construction during combustion operation while preventing it from being discharged from the oil reservoir directly to an exterior of the oil burner, to thereby eliminate a danger of a fire.

Figure 4:
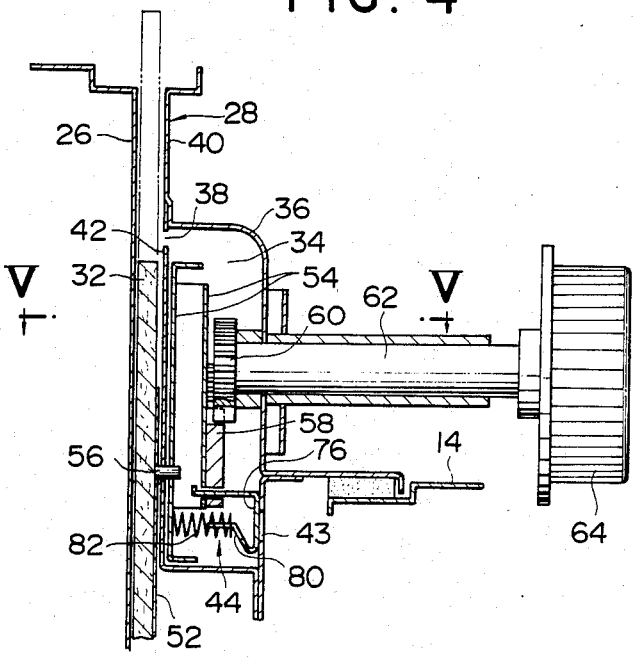
FIG. 4 is a fragmentary sectional view showing an essential part of another embodiment of a fire-extinguishing device according to the present invention.
Figure 5:
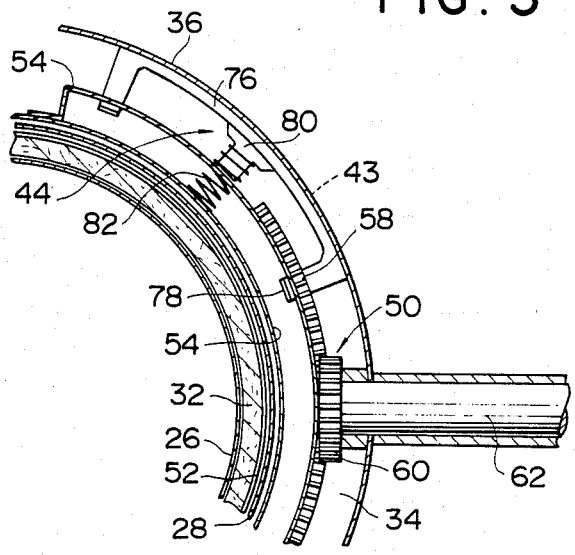
FIG. 5 is a sectional view taken along substantially line V—V of FIG. 4.

FIGS. 4 and 5 show another embodiment of a fire-extinguishing device according to the present invention.

In a fire-extinguishing device shown in FIGS. 4 and 5, a valve 44 is constructed in a manner different from the embodiment shown in FIGS. 1 to 3. More particularly, the valve 44 includes a valve body 76 comprising a shield plate for operating an aperture or through-hole 43 formed at a portion of an annular cover plate 36 of a top-open bell-like shape positioned in an oil reservoir 14. The cover plate 36 constitutes an outer wall of an air chamber 34. The valve body or shield plate 76 is arranged in the air chamber 34 and fixedly held at a plate member 54 so that it may be moved with the plate member 54 to selectively close the aperture 43. In the embodiment, the shield plate 76 is formed into a substantially C-shape in plane and a substantially L-shape in vertical section and is fixedly fitted at both lateral ends 78 of a horizontal portion thereof in the plate member 54 so that it may be moved integral with the plate member 54 when a wick operating shaft 62 is operated. One of the lateral ends or fixed engagements 78 of the shield plate 76 is fixed through a lower portion of a rack 58 to the plate member 54. The shield plate 76 is provided at a lower end of a vertical portion thereof with an inwardly extending plate-like projection 80, on which a spring 82 is securely fitted so that it may be interposed between the shield plate 76 and the plate member 54 to force the shield plate 76 against the cover plate 36. Thus, it will be noted that when the plate member 54 is rotated due to operation of the wick operating shaft 62, the shield plate 76 is rotated with the member 54 while sliding on the cover plate 36 to selectively close the aperture 43. In the embodiment, the shield plate 76 is positioned so that it may close or cover the aperture 43 to block communication between the air chamber 34 and the oil reservoir 14 when the wick operating shaft 62 is moved to a wick lowered position and open it to carry out the communication when it is moved to a wick raised position. In FIGS. 4 and 5, the wick is lowered to a wick lowered position or a fire-extinguishing position. However, when the valve 40 is incorporated in a fire-extinguishing device is of the type that introduction of air from an ambient atmosphere through an air chamber and a wick receiving chamber to a combustion cylinder construction is carried out during fire-extinguishing operation, positioning of the shield plate 76 with respect to the aperture 43 is carried out in a manner reverse to the above.

The remaining of the embodiment shown in FIGS. 4 and 5 may be constructed in substantially the same manner as that of FIGS. 1 to 3.

The embodiment of FIGS. 4 and 5 constructed as described above is operated in substantially the same manner as that of FIGS. 1 to 3. When the wick operating shaft 62 is operated or rotated, the plate member 54 is rotated in the air chamber 34 through engagement between a pinion 60 and the rack 58. This causes a wick retaining plate 52 to be rotated through connecting pin means 56 which operatively connects the wick retaining plate 52 to the plate member 54, resulting in the wick 32 being vertically moved while being rotated.

As described above, in the fire-extinguishing device of FIGS. 4 and 5, the valve body or shield plate 76 is fixed at the plate member 54 and constantly outwardly forced against an inner surface of the annular cover plate or outer wall 36 of the air chamber 34, so that it may be moved or rotated together with the plate member 54 while sliding on the outer wall 36, to thereby operate or selectively open the aperture 43 as desired.

Thus, it will be noted that the fire-extinguishing device is significantly simplified in its structure, particularly, its valve structure as well as accomplishes the above-noted advantages of the embodiment shown in FIGS. 1 to 3.

Also, the valve structure incorporated in the illustrated embodiment is satisfactorily applicable to any kind of a fire-extinguishing device for an oil burner. Further, the valve structure merely comprises the shield plate serving as the valve body and the spring, resulting in a significant decrease in the number of parts for the valve structure.

While preferred embodiments of the present invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A fire-extinguishing device for an oil burner including an oil reservoir for storing fuel oil therein which is communicated to an ambient atmosphere, comprising:

a wick receiving chamber for movably receiving a wick therein, said wick receiving chamber having a width larger than a thickness of said wick so as to be communicated to a combustion cylinder construction of the oil burner;

an air chamber arranged adjacent to said wick receiving chamber and provided with an opening for communicating said air chamber therethrough to said wick receiving chamber, said opening of said air chamber being arranged at a position above an upper end of said wick when said wick is at a wick lowered position;

a valve provided at said air chamber and actuated in association with movement of said wick so as to be opened when said wick is at a wick raised position and be closed when said wick is at said wick lowered position;

said valve being arranged at a portion of said air chamber which is positioned in a space of said oil reservoir so as to cause said air chamber to be communicated through said oil reservoir to an ambient atmosphere when said valve is opened.

2. A fire-extinguishing device as defined in claim 1, wherein said valve is actuated by a cam formed at a power transmitting means of said fire-extinguishing device operatively connected between a power generating means thereof and a wick moving means thereof, 3. A fire-extinguishing device as defined in claim 2, wherein said cam is formed on a rack which is operatively connected between a pinion of a wick operating shaft and a wick retaining plate;

said wick retaining plate being connected to said rack through a movable plate member on which said rack is mounted;

said rack, pinion and movable plate member constituting said power transmitting means, said wick operating shaft constituting said power generating means, and said wick retaining plate constituting said wick moving means.

4. A fire-extinguishing device as defined in claim 1, wherein said valve comprises a valve body for opening or closing an aperture formed at said air chamber through which said air chamber is communicated to said oil reservoir;

said valve body being arranged in said air chamber in a manner to be interposed between an outer wall of said air chamber and power transmitting means of said fire-extinguishing device, said power transmitting means being operatively connected between power generating means of said fire-extinguishing device and a wick moving means thereof and moved in association with movement of said power generating means;

said valve body being securely mounted on said power transmitting means so as to be moved with said power transmitting means; and a spring for constantly forcing said valve body against said outer wall of said air chamber.

5. A fire-extinguishing device as defined in claim 4, wherein said spring is interposed between said power transmitting means and said valve body.

6. A fire-extinguishing device as defined in claim 4, wherein said valve body comprises a shield plate.

7. A valve structure for a fire-extinguishing device for an oil burner which is adapted to selectively close an aperture provided at an outer wall of an air chamber of the fire-extinguishing device to communicate said air chamber to an ambient atmosphere, comprising:

a valve body arranged in said air chamber in a manner to be interposed between an outer wall of said air chamber and power transmitting means of said fire-extinguishing device, said power transmitting means being operatively connected between power generating means of said fire-extinguishing device and a wick moving means thereof and moved in association with movement of said power generating means to vertically move a wick through said wick moving means;

said valve body being securely mounted on said power transmitting means so as to be moved with said power transmitting means; and a spring for constantly forcing said valve body against said outer wall of said air chamber to cause said valve body to selectively close said aperture depending on its movement with said power transmitting means.

8. A valve structure as defined in claim 7, wherein said spring is interposed between said power transmitting means and said valve body.

9. A valve structure as defined in claim 7, wherein said valve body comprises a shield plate.

10. A valve structure as defined in claim 7, wherein said aperture is provided at a portion of said air chamber which is positioned in a space of an oil reservoir communicated to said ambient atmosphere and said valve selectively communicates said air chamber through said oil reservoir to said ambient atmosphere.

* * * * *